US008070915B2

(12) United States Patent
Ahmaniemi et al.

(10) Patent No.: US 8,070,915 B2
(45) Date of Patent: Dec. 6, 2011

(54) STATIC DEWATERING ELEMENT FOR A WEB FORMING MACHINE AND A METHOD FOR COVERING A STATIC DEWATERING ELEMENT DESIGNED FOR A WEB FORMING MACHINE

(75) Inventors: Antti Ahmaniemi, Muurame (FI); Veli-Pekka Tarkiainen, Muurame (FI)

(73) Assignee: Metso Paper, Inc., Helsinki (FI)

( * ) Notice: Subject to any disclaimer, the term of this patent is extended or adjusted under 35 U.S.C. 154(b) by 376 days.

(21) Appl. No.: 12/298,886

(22) PCT Filed: Apr. 27, 2007

(86) PCT No.: PCT/FI2007/050239

§ 371 (c)(1),
(2), (4) Date: Oct. 28, 2008

(87) PCT Pub. No.: WO2007/135231

PCT Pub. Date: Nov. 29, 2007

(65) Prior Publication Data

US 2009/0173467 A1 Jul. 9, 2009

(30) Foreign Application Priority Data

May 19, 2006 (FI) ..... 20065343

(51) Int. Cl.
*D21F 1/48* (2006.01)
*D21F 1/52* (2006.01)

(52) U.S. Cl. ..... 162/199; 162/352; 162/272; 427/446; 427/454

(58) Field of Classification Search ..... 162/135–137, 162/351–352, 361, 363, 374, 199, 272; 427/446, 427/452–454; 428/411.1, 469, 472, 701–702
See application file for complete search history.

(56) References Cited

U.S. PATENT DOCUMENTS

| | | | | | |
|---|---|---|---|---|---|
| 2,763,569 | A | * | 9/1956 | Bradstreet et al. | 427/314 |
| 2,991,191 | A | * | 7/1961 | Montgomery et al. | 427/190 |
| 3,239,409 | A | * | 3/1966 | Knowles | 162/352 |
| 3,446,702 | A | * | 5/1969 | Buchanan | 162/374 |
| 3,497,420 | A | * | 2/1970 | Clark | 162/352 |
| 3,778,342 | A | * | 12/1973 | Charbonneau | 162/352 |
| 3,975,568 | A | * | 8/1976 | Rudness | 428/329 |
| 4,004,969 | A | * | 1/1977 | Beauchemin | 162/352 |
| 4,331,511 | A | * | 5/1982 | Goddard et al. | 162/352 |
| 4,508,788 | A | * | 4/1985 | Cheney | 428/570 |
| 4,532,009 | A | * | 7/1985 | Nickerson | 162/351 |
| 4,687,549 | A | * | 8/1987 | Kallmes | 162/352 |
| 4,838,996 | A | * | 6/1989 | Kallmes | 162/352 |
| 4,880,500 | A | * | 11/1989 | Eldridge et al. | 162/279 |
| 5,562,807 | A | * | 10/1996 | Baluha | 162/352 |

(Continued)

FOREIGN PATENT DOCUMENTS

FI 96437 B 3/1996

(Continued)

*Primary Examiner* — Jose A Fortuna
(74) *Attorney, Agent, or Firm* — Stiennon & Stiennon

(57) ABSTRACT

A static dewatering element (10) for a web forming machine has a thermally sprayed coating (26) manufactured of powder particles (34). The powder particles (34) are agglomerates composed of primary particles (36). The average size of the primary particles (36) is smaller than 0.5 μm. The invention also relates to a method for covering a static dewatering element designed for a web forming machine.

6 Claims, 4 Drawing Sheets

U.S. PATENT DOCUMENTS

| | | | | |
|---|---|---|---|---|
| 5,830,322 | A * | 11/1998 | Cabrera y Lopez Caram et al. | 162/209 |
| 5,922,173 | A * | 7/1999 | Neun et al. | 162/352 |
| 5,932,072 | A * | 8/1999 | Neun et al. | 162/352 |
| 6,025,034 | A * | 2/2000 | Strutt et al. | 427/450 |
| 6,030,501 | A * | 2/2000 | Neun et al. | 162/352 |
| 6,274,002 | B1 * | 8/2001 | Rulis et al. | 162/352 |
| 6,277,448 | B2 * | 8/2001 | Strutt et al. | 427/452 |
| 6,444,094 | B1 * | 9/2002 | Rulis et al. | 162/352 |
| 6,517,802 | B1 * | 2/2003 | Xiao et al. | 423/592.1 |
| 6,562,197 | B2 * | 5/2003 | Forester | 162/352 |
| 6,579,573 | B2 * | 6/2003 | Strutt et al. | 427/452 |
| 7,291,248 | B2 * | 11/2007 | Tarkiainen et al. | 162/352 |
| 7,491,295 | B2 * | 2/2009 | Poikolainen et al. | 162/203 |
| 2001/0004473 | A1 * | 6/2001 | Strutt et al. | 427/446 |
| 2001/0025697 | A1 * | 10/2001 | Wildfong et al. | 162/301 |
| 2002/0060040 | A1 * | 5/2002 | Rulis et al. | 162/352 |
| 2002/0066546 | A1 * | 6/2002 | Forester | 162/352 |
| 2003/0077398 | A1 * | 4/2003 | Strutt et al. | 427/452 |
| 2003/0106663 | A1 * | 6/2003 | Tarkiainen et al. | 162/352 |
| 2004/0144514 | A1 * | 7/2004 | Bidlingmaier et al. | 162/352 |
| 2005/0150627 | A1 * | 7/2005 | Frawley et al. | 162/352 |
| 2006/0275542 | A1 * | 12/2006 | Mehta et al. | 427/180 |
| 2007/0144699 | A1 * | 6/2007 | McPherson | 162/374 |
| 2008/0113105 | A1 * | 5/2008 | Raz | 427/446 |
| 2008/0182114 | A1 * | 7/2008 | Kim et al. | 428/469 |
| 2009/0173467 | A1 * | 7/2009 | Ahmaniemi et al. | 162/213 |

FOREIGN PATENT DOCUMENTS

| | | | |
|---|---|---|---|
| FI | 110439 | B | 1/2003 |
| JP | 10195790 | A | 7/1998 |
| JP | 2007291523 | A * | 11/2007 |
| WO | 96/24717 | A1 | 8/1996 |
| WO | 01/21850 | A1 | 3/2001 |
| WO | 2007/135231 | A1 | 11/2007 |
| WO | WO 2007135231 | A1 * | 11/2007 |
| WO | WO 2008152192 | A1 * | 12/2008 |

* cited by examiner

STATIC DEWATERING ELEMENT FOR A WEB FORMING MACHINE AND A METHOD FOR COVERING A STATIC DEWATERING ELEMENT DESIGNED FOR A WEB FORMING MACHINE

CROSS REFERENCES TO RELATED APPLICATIONS

This application is a U.S. national stage application of International App. No. PCT/FI2007/050239, filed Apr. 27, 2007, the disclosure of which is incorporated by reference herein, and claims priority on Finnish App. No. 20065343, filed May 19, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a static dewatering element for a web forming machine, said dewatering element comprising a thermally sprayed coating manufactured of powder particles. The invention also relates to a method for covering a dewatering element designed for a web forming machine.

Dewatering elements of a web forming machine are traditionally manufactured of a solid ceramic material. However, the manufacture of solid ceramic dewatering elements is expensive. Therefore, the dewatering elements can be manufactured at lower cost by covering a suitable metal. Patent FI 96437 proposes a dewatering element consisting mainly of an aluminum profile. The aluminum profile is covered with an oxide layer provided by electrolytic plasma oxidation or spray explosion covering, for example. However, the method according to this patent as well as other known methods can only be used for manufacturing coatings with a porosity of over 1%. Such a high porosity creates a risk of pit corrosion at the boundary of the frame layer and the coating, which can lead to the detachment of the coating during use. In addition, filler particles attach to a porous material, which then consume the fabric contacting the dewatering element. The surface roughness of the dewatering elements according to prior art has typically ranged between 0.4-0.8 μm. The surface roughness is high with known coatings causing fast fabric wear.

SUMMARY OF THE INVENTION

The object of the invention is to provide a novel static dewatering element for a web forming machine having a lower surface roughness and porosity than those of known covered dewatering elements. Another object of the invention is to provide a new method for covering a static dewatering element located in a web forming machine in such a way that the roughness and porosity of the dewatering element are lower than those of known covered dewatering elements. For the coating of the dewatering element according to the invention, primary particles are used whose average size distribution is smaller than 0.5 μm.

Static dewatering elements are commonly used in the forming sections of the web forming machines. In addition, static dewatering elements are also used in the press section. In dewatering elements it is possible to use a thermally sprayed coating on top of the frame layer, which allows using very many different types of materials as the frame layer. The characteristics of the dewatering element can be changed by covering the frame layer of the dewatering element. For example, the frame layer can be made of a ceramic material or a metal. The metal can be stainless steel or aluminum, for example. Covering can be implemented by thermally spraying powder particles on top of the frame layer. The coating can be sprayed thermally using, for example, plasma or high-speed flame spraying methods. Surprisingly, using agglomerates as the powder particles consisting of primary particles whose average size is smaller than 0.5 μm, it is possible to essentially improve the surface roughness of the final coating compared to the prior art solutions. The particles used in covering can be oxides, such as chromium oxide, or carbides, such as tungsten carbide. When covering the dewatering element according to the invention, in addition to the reduction of the surface roughness, the surface porosity surprisingly reduces, i.e. improves. The same or a better level can be achieved both in the surface roughness and in the porosity compared to solid ceramics, i.e. the porosity is less than 1%, and the surface roughness is below 0.3 μm.

The characteristics of the dewatering element according to the invention are in a completely new level compared to known dewatering elements, in the manufacture of which covering has been used. When comparing the covered dewatering element according to the invention to solid ceramic dewatering elements, it can be noted that manufacturing a covered dewatering element is notably less expensive.

In one embodiment, agglomerates formed by primary particles comprise a base material and a blend material. In this case, even better coating properties can be achieved. The number of blend materials can be one or more. The blend materials can improve the properties of the base material. For example, the blend materials can improve the surface smoothness of the coating, i.e. reduce the surface roughness, maintaining at the same time the properties of the base material, such as the wear resistance. In addition, the blend materials can improve the surface smoothness.

The invention is described below in detail by making reference to the enclosed drawings, which illustrate some of the embodiments of the invention.

DESCRIPTION OF THE PREFERRED EMBODIMENTS

Figure 1:
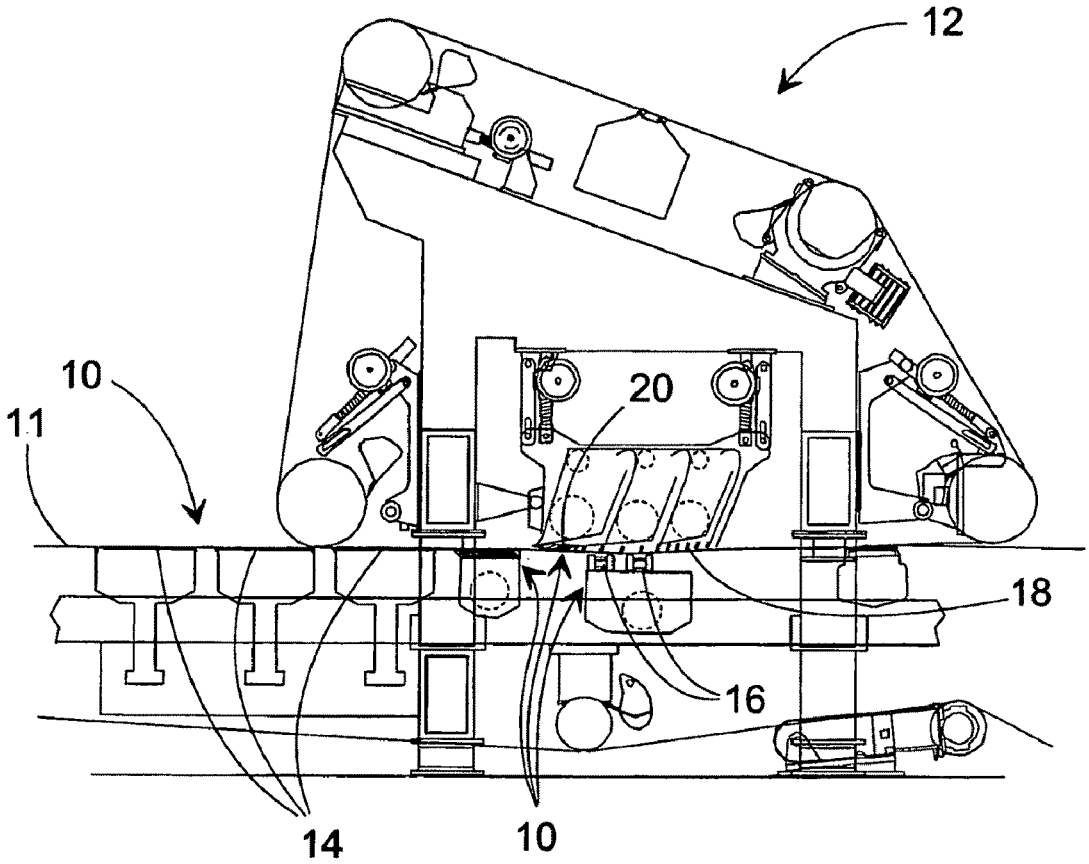
FIG. 1 shows applications for a dewatering element according to the invention in a forming section of a web forming machine.

FIG. 1 shows possible applications of the dewatering element 10 according to the invention. In the covering method according to the invention for a static dewatering element, covering is carried out using a thermally sprayable coating which comprises powder particles. These powder particles used in the coating are, according to the invention, agglomerates comprising primary particles for which the average size is selected smaller than 0.5 μm. Dewatering elements covered according to such a method can be used in many positions in the forming section 12 of a web forming machine. The web forming machine can be a paper machine or a board machine, for example. The dewatering element 10 can be a blade cover 14, a loading element 16, a foil blade 18, a curved perforated cover or a slotted cover 20. Dewatering elements are used for removing water from the web via fabrics 11. The fabrics 11 are in contact with the dewatering elements and cause abrasive wear to the dewatering elements. A dewatering element with a coating according to the invention can be applied in many other positions, too, such as in the press section, for dewatering elements contacting clothing fabrics and felts. Such positions are, for example, the covers of the Uhle boxes or transfer suction boxes. As described above, the method according to the invention can be used for covering dewatering elements contacting many types of clothing, such as felts and fabrics.

Figure 2:
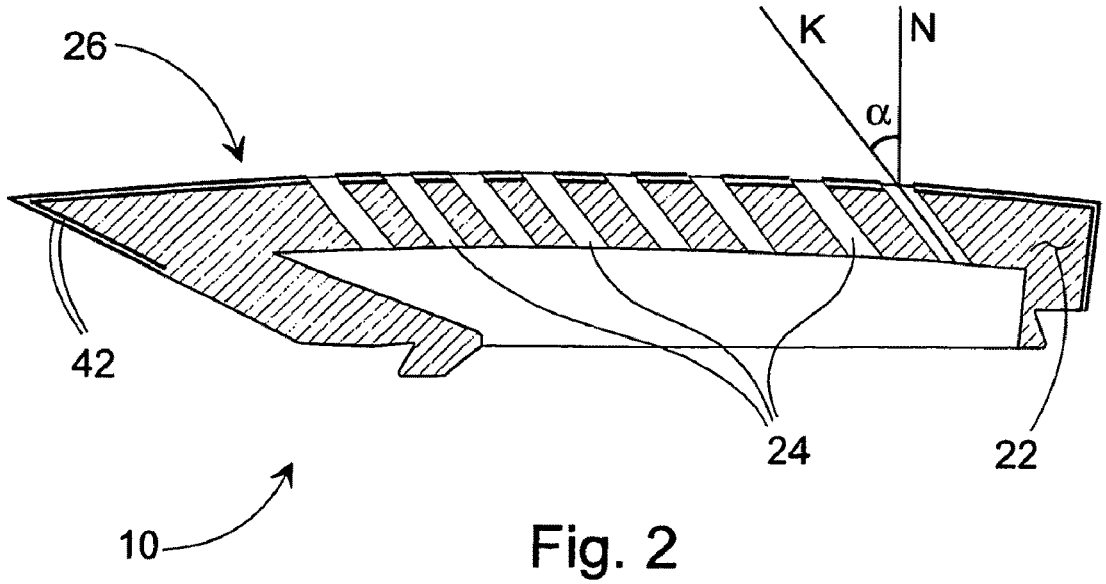
FIG. 2 shows a dewatering element according to the invention.

The dewatering element 10 according to the invention shown in FIG. 2 has a thin thermally sprayed coating layer, having a thickness of for example 10-1000 μm, advantageously 10-500 μm, on top of the frame layer. The frame layer 22 can be of a composite material, plastic or metal, for example. Advantageously the composite material is carbon or glass fiber composite. On the other hand, the frame layer is advantageously made of a metal, which can be stainless steel or aluminum, for example. The openings 24 in the dewatering element 10, i.e. their medians K drawn in the longitudinal direction, are in an angle α of over 30° relative to the normal N of the lateral-direction surface of the dewatering element 10. Advantageously the openings are in an angle of 35-50°. As the angle α between the openings' longitudinal direction and the normal of the dewatering element lateral direction surface increases, dewatering improves. In this application, making openings in an angle α of over 30° in the solid ceramic dewatering element has been very difficult and expensive mainly due to production-technical reasons. The material selection of the frame layer in the dewatering element according to the invention enables its being handled with work methods that permit making the openings in an angle of 45°, for example. When the openings are in an angle of 45°, for example, dewatering is more efficient compared to a situation in which the openings are in an angle of 30°.

The dewatering element according to the invention shown in FIG. 2 is provided with a coating 26. The coating 26 is shown in FIG. 2 much thicker than it actually is. The roughness of the outer surface of the dewatering element coating according to the invention is smaller than 0.3 μm. As the surface roughness of the outer surface of the coating reduces, the friction forces between the outer surface and the fabric decrease. Thus it is possible to obtain an application, in which the fabric and the coating wear less than before or notably more slowly than before. Surprisingly it has been discovered that even a level of 0.1 μm can be achieved for the surface roughness of a coating based on tungsten carbide.

The method according to the invention for covering a dewatering element can be used to manufacture a dewatering element having a surface porosity of less than 1%. When the porosity is less than 1%, an extremely dense coating can be achieved. Further, such a dense coating allows achieving a better corrosion resistance of the dewatering element compared to heretofore. In addition, filler particles used in the paper do not attach to the surface. This allows avoiding the roughening effect of the filler particles against the dewatering element surface, which increases the fabric wear. The porosity of the coating is a problem particularly for known oxide ceramics, such as $Cr_2O_3$, $TiO_2$, $Al_2O_3$, $SiO_2$ or $ZrO_2$.

The dewatering element 10 according to the invention shown in FIG. 2 has two coating layers 42, so the coating 26 is composed of two coating layers 42. The number of coating layers can also be greater than two. Multiple layers can be used, for example, for attaching the coating to the frame layer of the dewatering element or as a wear indicator for the coating. An adhesive layer can be used if the coating layer otherwise fails to attach to the frame layer to be covered. When functioning as wear indicators, the coating layers must be of a different color. Advantageously, for the adhesive layer, a different material is used than for the outermost coating layer, so this adhesive layer simultaneously functions as an indicator. With such a structure of two coating layers, as is also shown in FIG. 2, a simpler covering process can be achieved than when using more layers than this.

The openings 24 of the dewatering element 10 shown in FIG. 2 have been treated with a surface treatment agent having a low surface energy. Thus water and water-bonded fibers, stock and fillers do not spread or attach to the surface of the opening but flow through more easily from the opening along with water. Thus the surface is more easily kept clean compared to the situation without a surface treatment that decreases surface energy. For reducing the openings' surface energy, a hybrid coating is used as the coating.

In FIG. 2, the coating is only on the surface of the dewatering element, which is in contact with the fabric in the application position of the dewatering element. The coating can also be around the entire dewatering element. In other words, the coating can be made in exactly the desired parts of the dewatering element.

Figure 3A:
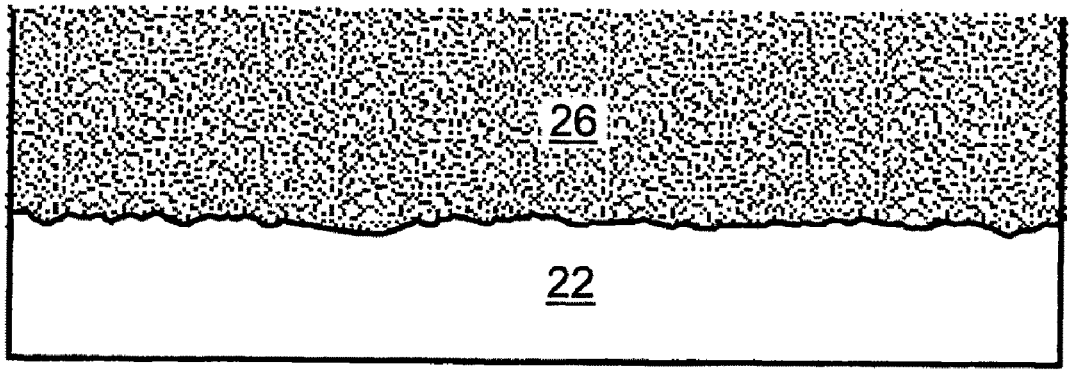
FIG. 3*a* is a cross-sectional view of the structure of the coating for a dewatering element according to the invention.
Figure 3B:
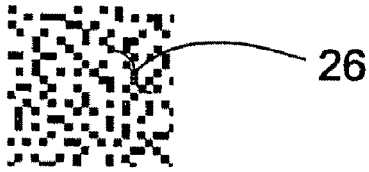
FIG. 3*b* is an enlargement of a part of FIG. 3*a*.
Figure 4A:
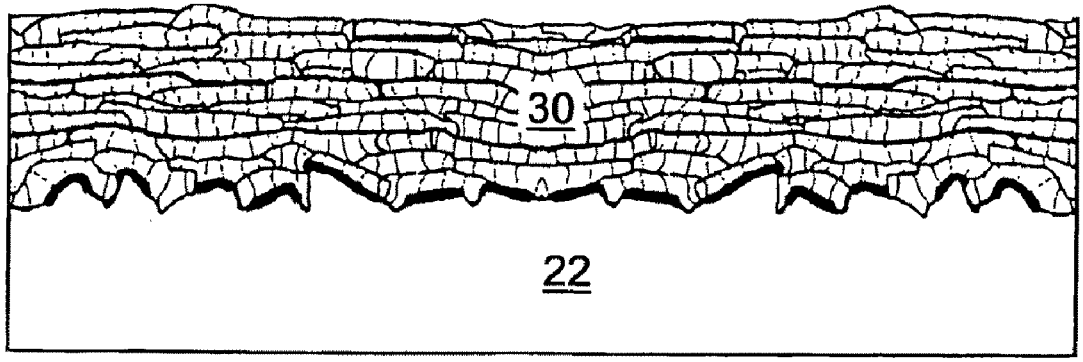
FIG. 4*a* is a cross-sectional view of the structure of a prior art coating for a dewatering element according to prior art.
Figure 4B:
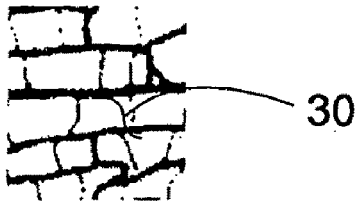
FIG. 4*b* is an enlargement of a part of the prior art coating of FIG. 4*a*.

When comparing the coating 26 according to the invention placed on top of the frame layer 22 shown in FIG. 3*a* to the coating 30 according to prior art shown in FIG. 4*a*, it can be seen that the coating 26 according to the invention is remarkably smoother. FIGS. 3*b* and 4*b* are enlargements of FIGS. 3*a* and 4*a*. The enlargements show well that the coating in FIG. 3*b* is notably smoother than the coating in FIG. 4*b*. The phase discontinuities in the coating according to the invention, shown in FIG. 3*a* and enlarged in FIG. 3*b*, are below 0.5 μm. When interpreting the figures it should be taken into account that they are not cross-sections of actual surfaces but illustrate the difference in principle between the prior art coating and that according to the invention. In any case, the coating of FIG. 4*a* is clearly more porous than the coating of FIG. 3*a*.

Figure 5:
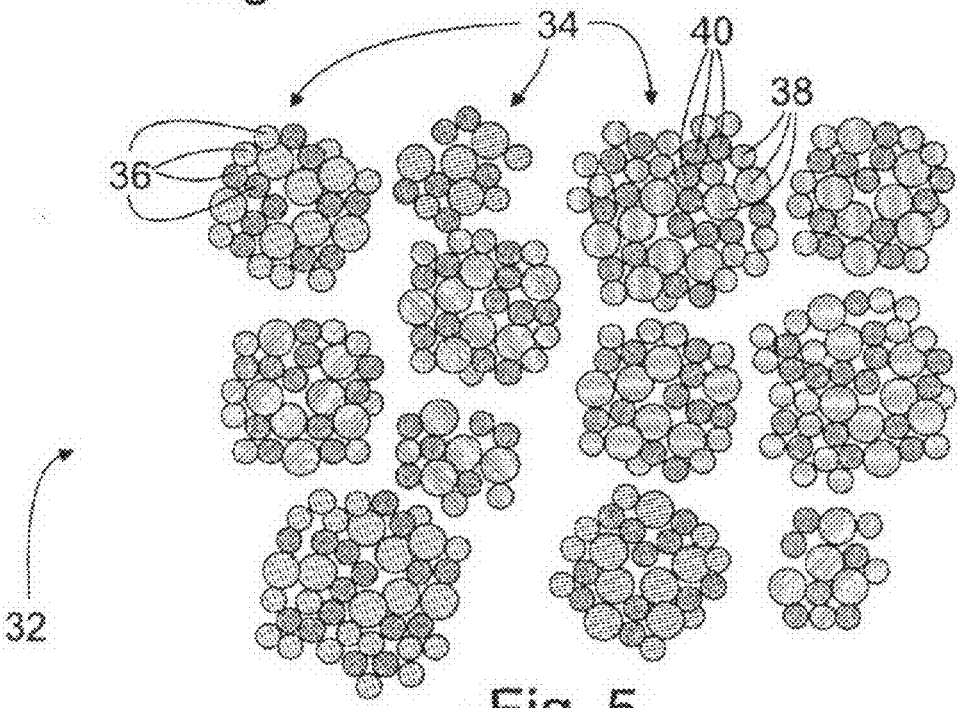
FIG. 5 shows the formation of particles of the coating according to the invention from primary particles.

In the powder 32 used in the covering process according to the invention as shown in FIG. 5, the powder particles 34 are composed of several primary particles 36. In other words, the primary particles 36 form agglomerates, which function as actual powder particles 34 i.e. coating particles. The size of the powder particles can vary even very widely. The largest powder particles contained in the powder can be 50 μm, while the smallest can be as small as 2 μm. These particles are composed of primary particles the average size of which is smaller than 0.5 μm. Surprisingly, the size of the primary particles is decisive when trying to obtain smoother and denser coatings than heretofore. As the size of the primary particles reduces from 0.5 μm, the properties of the coating are maintained on the shown level or they may even improve from the earlier ones. Thus it is essential that when the average particle size is 0.5 μm or smaller, the same or a better level of surface properties is achieved compared to solid ceramic materials and particularly a better level than with earlier covered dewatering elements.

As shown in FIG. 5, the powder particles 34 i.e. agglomerates can include a base material 38 and a blend material 40. The coating particles can be composed of one or more materials. Advantageously, the coating particles 34 comprise a base material 38 and blend materials 40, whereby even better coating properties are achieved. As blend materials, the same materials can be used as for basic materials. The number of blend materials can be one or more. The coating can be made completely of a base material, for example of oxide ceramic, such as $Cr_2O_3$, $TiO_2$, $Al_2O_3$, $SiO_2$ or $ZrO_2$. The coating can also be a mixture of oxide ceramics. Then the blend materials can improve the properties of the base material. For example, the porosity of the coating surface can be reduced with the blend materials, maintaining at the same time the properties of the base material, such as the wear resistance. In addition, the blend materials can improve the surface smoothness of the coating.

Using blend materials is advantageous particularly when applying covering based on carbides. When the base material is tungsten carbide, the surface roughness can be reduced by adding a blend material, which can be, for example, metallic cobalt, chromium, nickel, boron or silicon. Surprisingly, when using such a mixture, even lower surface roughnesses have been achieved than with solid ceramics. This application offers quite new types of dewatering elements to be used in a web forming machine, since such dewatering elements are less expensive to manufacture than solid ceramic dewatering elements. In addition, their surface roughness is lower than that of solid ceramic dewatering elements.

The powder particles used in covering a dewatering element can comprise 75-95%, advantageously 80-90%, of the base material. When the amount of base material is 75-95%, advantageously 80-90%, it is possible to achieve an application, in which the good properties of the base material, such as the wear resistance, are maintained, but the blend material provides desired properties, such as a lower pore volume or a better smoothness of the coating. Advantageously, the number of blend materials is one and it makes 5-25%, advantageously 10-20%, of the coating.

Figure 6:
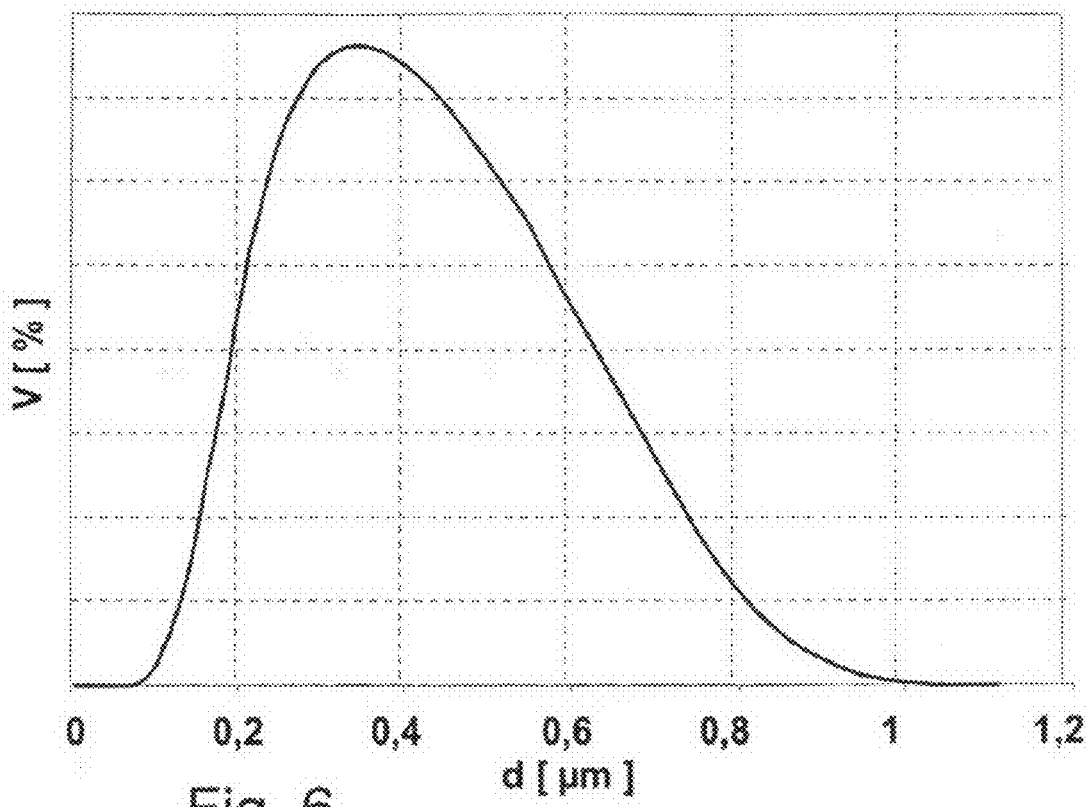
FIG. 6 shows the size distribution of the primary particles used in the covering process according to the invention.

FIG. 6 shows one example of the size distribution, which the primary particles used in the covering according to the invention can have. The horizontal axis of the graph represents the diameter (d) of the primary particles, and the unit used is μm. The vertical axis, in turn, shows the portion (%) of each size class of the particles from the volume (V). The size distribution is thus processed as volume percentages. The size distribution can be controlled as desired using various methods. For example, the size distribution can have the shape of the Gaussian curve, but particularly when controlled, the size distribution does not follow the shape of the Gaussian curve. While the size distribution of the particles can be controlled towards a desired direction, a particular size distribution always remains for the particles. FIG. 6 shows one size distribution of the primary particles in which the average size of the primary particles is smaller than 0.5 μm. Only a small portion of the particles are larger than 1 μm. Small portions of larger primary particles do not degrade the properties significantly. Thus even such primary particle size distributions which are shallow, will realize the inventional idea.

Figure 7:
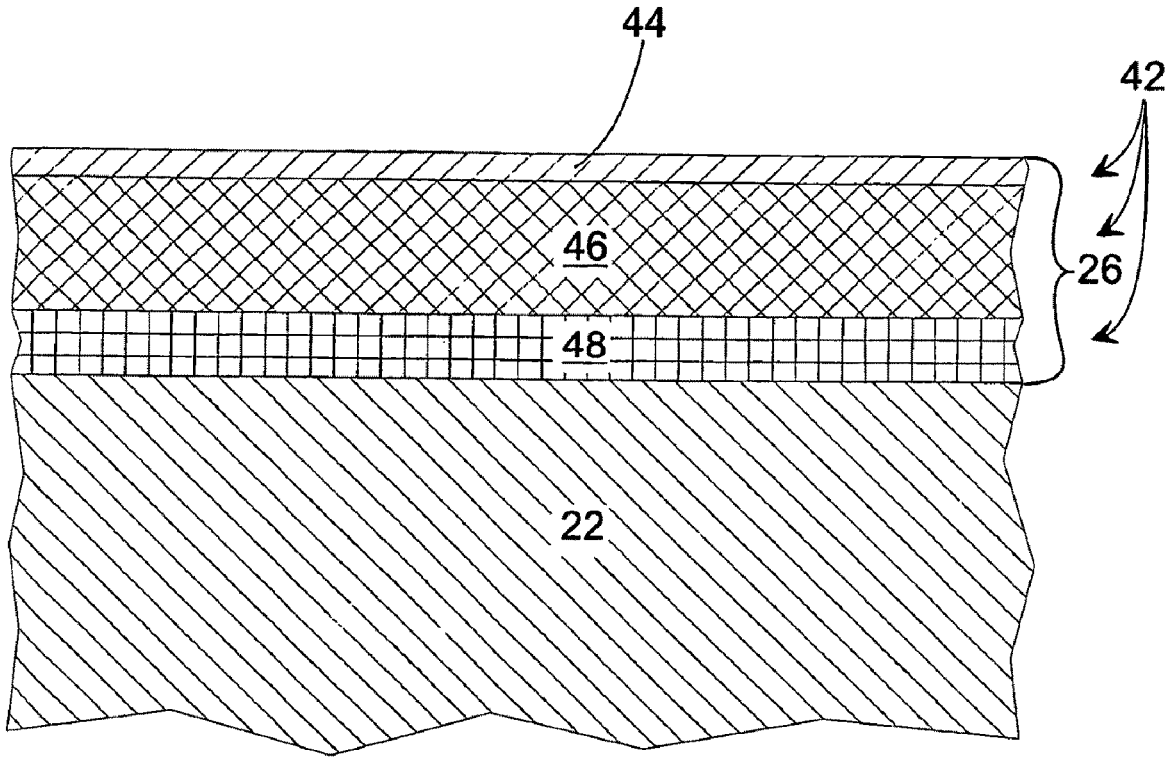
FIG. 7 shows the coating of the dewatering element according to the invention, which is composed of several coating layers.
Figure 1:
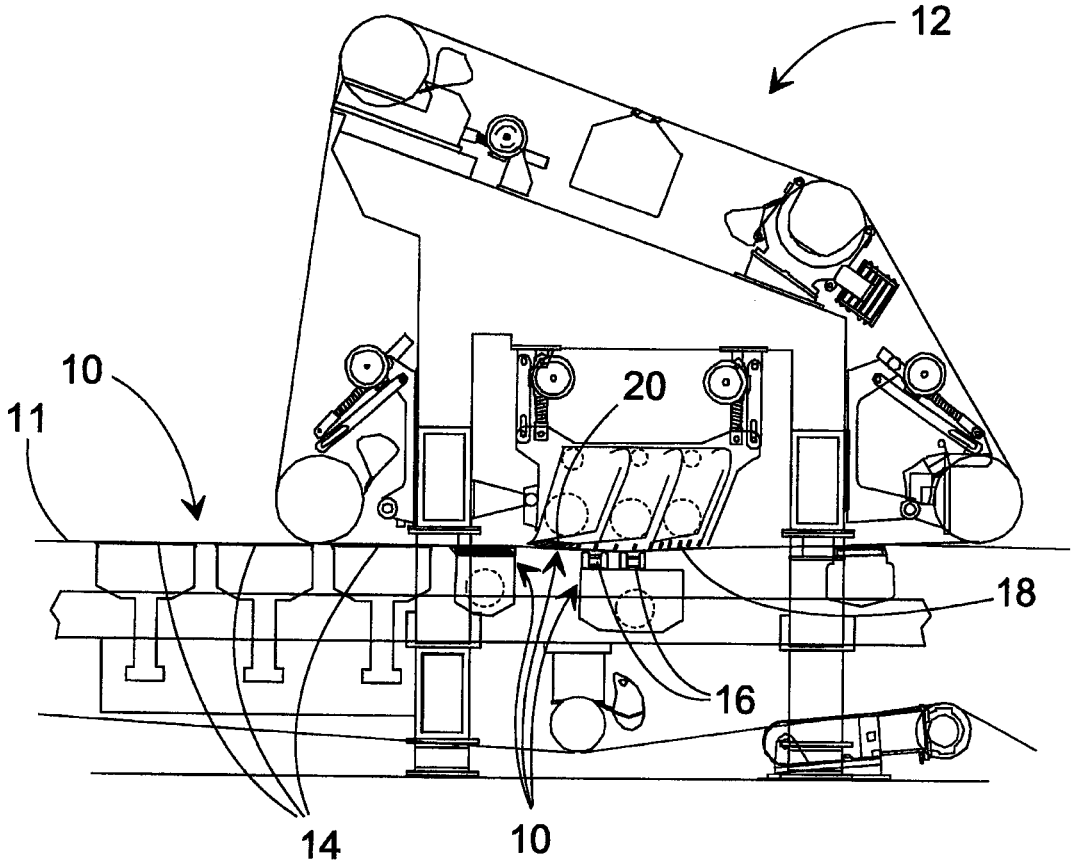
Figure 2:
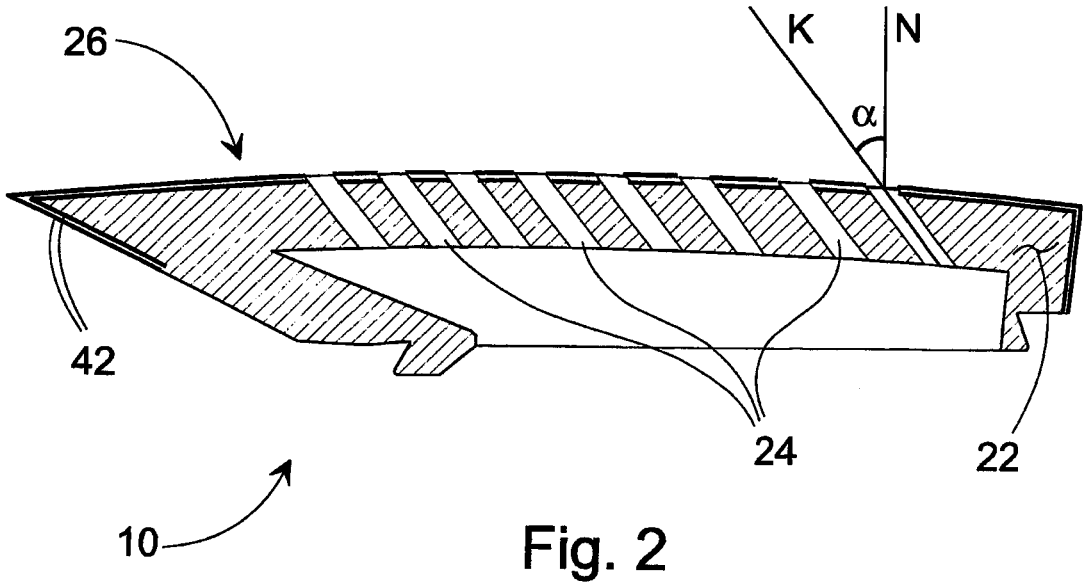
Figure 3A:
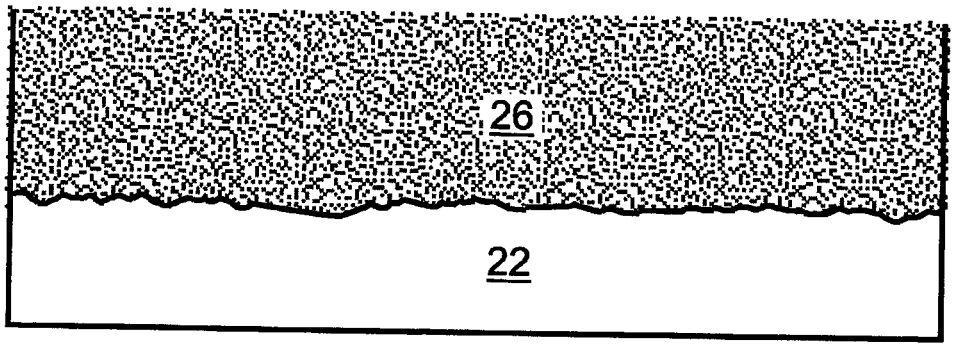
Figure 3B:
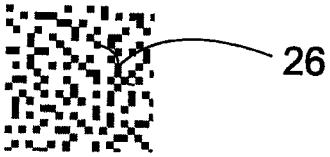
Figure 4A:
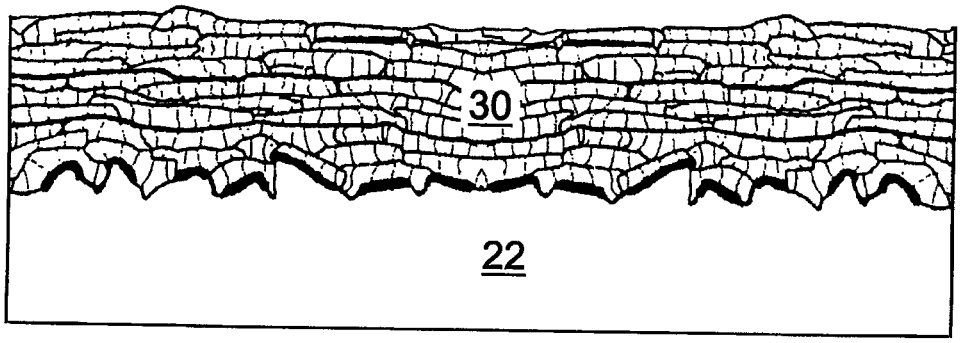
Figure 4B:
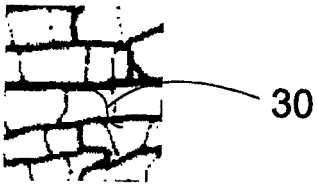
Figure 1:
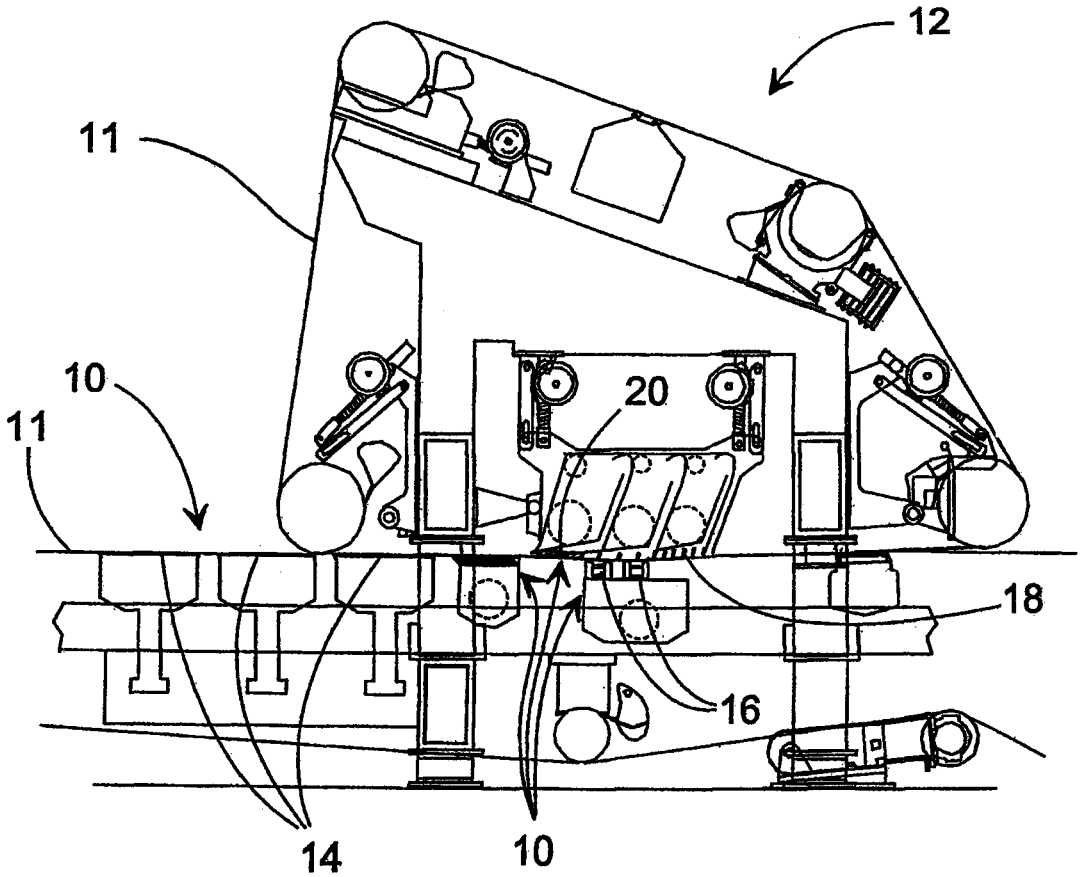
Figure 2:
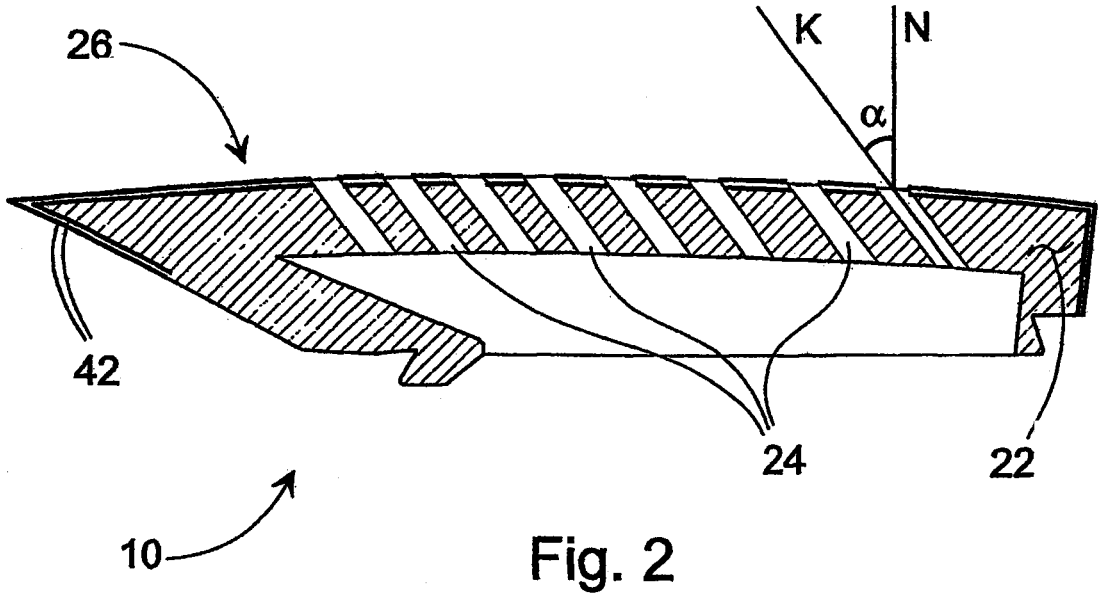

FIG. 7 shows a coating 26 of the dewatering element according to the invention, which is composed of several coating layers 42. In other words, the coating 26 is composed of at least two coating layers 42. In this embodiment, the coating layers 42 of the coating 26 are the surface layer 44, the center layer 46, and the bonding layer 48. The bonding layer 48 is used to attach the coating 26 to the frame layer 22, i.e. the base material. This solution can be used utilizing both nanocarbides and oxide ceramics. A layered structure enables the advantages of several techniques in the same coating.

In one advantageous embodiment the surface layer is relatively hard. In other words, the hardness of the surface layer is such that it allows easy grinding and adapts smooth in the machine. Nonetheless, the surface layer resists wear. Therefore, the surface layer can be said to be relatively hard. Thus the surface layer functions as an adaptive surface during grinding and in the early stage of use. The surface layer adapts quickly to the process. In addition, the relatively hard surface layer is easier and quicker to grind than the hard center layer. The surface layer can be, for example, of a ceramic material which has suitable properties. In contrast, the center layer is extremely hard and wear resistant. According to the invention, the center layer functions as the wear resistant layer. The hardness of the bonding layer is between those of the surface layer and the center layer. Consequently, it can be said that the bonding layer is hard. More essential than the hardness of the bonding layer is that it attaches well both to the base material and the center layer. With this surface layered structure it is possible to achieve a better dewatering element surface quality than before and further, a better fabric contact. In addition, the price of the coating is less expensive than heretofore, since grinding hard materials, which are used for instance in the center layers, is expensive and slow.

The colors of these at least two coating layers are advantageously different. For example, the coating layer with a different color can be the bonding layer, which then functions as an indicator for wear and/or misalignment. The hard center layer can also be of a different color than the surface layer. Thus the information on the coating wear can be obtained very early, and the wear can be easily detected visually. Any misalignments are detected at the same time. For example, the surface layer can be black, while the center layer can have a metal color. In this case the bonding layer can be red, for example.

The above described dewatering element according to the invention can be covered using a method according to the invention. Covering is performed using a thermally sprayable coating comprising powder particles. The powder particles are agglomerates comprising primary particles, for which an average size smaller than 0.5 μm is selected.

In one embodiment, a coating produced with the method according to the invention is sealed after covering using a sealant. Sealing can be used with oxide and carbide ceramics. Advantageously sealing is used with oxide ceramics. When an oxide ceramic surface is sealed, the surface porosity decreases remarkably. Sealing can be made using an organic or an inorganic sealant. Sealing helps decreasing the surface porosity remarkably. This reduces notably the possibility of pit corrosion, for example. As the risk of pit corrosion decreases, the durability of the coating improves. When manufacturing extremely dense surfaces, applications are achieved in which the corrosion resistance required of the frame layer under the coating is not any more as high as in the applications according to prior art. Consequently, it is possible to use less expensive materials for the frame layer compared to heretofore. In addition, sealing helps reducing the surface roughness.

After sealing, the coating is ground. The sealant and grinding improve the surface quality achieved with covering, i.e. reduce the surface roughness and porosity. This reduces the fabric wear remarkably. Sealing and grinding are significant particularly when using coatings based on oxides.

The dewatering elements according to the invention can be recovered after use. The coating is easily removable from a used dewatering element, after which the dewatering element can be covered again. With re-covering notable cost savings as well as a reduced environmental load are achieved.

The invention claimed is:

1. A method for coating a static dewatering element for a web forming machine, comprising the steps of:

forming a hard wear resistant intermediate layer;

forming a surface layer on the intermediate layer which surface layer is less hard and less wear resistant, by thermally flame spraying the static dewatering element to form a coating with flame sprayable powder particles which are agglomerates, the agglomerates consisting essentially of: primary particles of an average size smaller than 0.5 μm, and a minimum size of 0.1 μm and a maximum size of 1.0 μm; and grinding the less hard and less wear resistant surface layer.

2. The method of claim 1 wherein the coating is sealed using a sealant after forming the coating.

3. The method of claim 2 wherein the coating is ground after sealing.

4. The method of claim 3 further comprising re-covering the dewatering element after use.

5. A static device used for dewatering a web in a web forming machine, comprising:

a dewatering element having a frame layer composed of a material selected from the group consisting of: carbon composite material, glass fiber composite, stainless steel, and aluminum;

a bonding layer which is a thermally sprayed coating and bonded to the frame layer;

a center layer which is a thermally sprayed coating, the center layer overlying the bonding layer and bonded to the frame layer by the bonding layer;

a surface layer overlying the center layer and forming a surface which engages a fabric or felt in a web forming section or a press section of a web forming machine, the surface layer formed by a thermally sprayed coating, the surface layer being on top of the center layer and being composed of powder particles that are agglomerates consisting essentially of: primary particles of an average size of less than 0.5 μm, and a minimum size of 0.1 μm and a maximum size of 1.0 μm wherein the surface which engages a fabric or felt has a roughness smaller than 0.3 μm;

wherein the surface layer, the center layer and the bonding layer have a thickness of 10-1000 μm;

wherein the primary particles are 80-90% base material and 10-20% blend material; the base material being selected from the group consisting of: $Cr_2O_3$, $TiO_2$, $Al_2O_3$, $SiO_2$, $ZrO_2$, and tungsten carbide; and the blend material being selected from the group consisting of: cobalt, chromium, nickel, boron and silicon;

wherein the surface layer is wear resistant but less hard and less wear resistant than the center layer, and wherein the bonding layer has a hardness between those of the surface layer and the center layer; and wherein the dewatering element has portions forming openings which perforate the frame layer, the openings having medians which are at a first angle of 35° to 50° relative to a normal of the surface which engages a fabric or felt, and the first angle measured in the direction from which a fabric or felt comes as it moves over the surface which engages a fabric or felt and wherein the portions forming openings are treated with a surface energy reducing agent.

6. The dewatering element of claim 5 wherein the surface layer and the center layer are of different colors.

* * * * *

UNITED STATES PATENT AND TRADEMARK OFFICE

CERTIFICATE OF CORRECTION

PATENT NO. : 8,070,915 B2
APPLICATION NO. : 12/298886
DATED : December 6, 2011
INVENTOR(S) : Ahmaniemi et al.

It is certified that error appears in the above-identified patent and that said Letters Patent is hereby corrected as shown below:

In the drawings, replace sheet 1 containing Figs. 1 and 2 and sheet 2 containing Figs. 3a, 3b, 4a and 4b with the attached drawing sheets.

Signed and Sealed this
Nineteenth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,070,915 B2
APPLICATION NO. : 12/298886
DATED : December 6, 2011
INVENTOR(S) : Antti Ahmaniemi et al.

It is certified that error appears in the above-identified patent and that said Letters Patent is hereby corrected as shown below:

On title page, delete illustrative FIG. 1 and substitute therefore with FIG. 1 as shown on replacement sheet 1 of 4 attached.

In the drawings, replace sheet 1 containing FIGS. 1 and 2 and sheet 2 containing FIGS. 3a, 3b, 4a and 4b with the attached drawing sheets.

This certificate supersedes the Certificate of Correction issued February 19, 2013.

Signed and Sealed this
Twenty-sixth Day of March, 2013

Teresa Stanek Rea
*Acting Director of the United States Patent and Trademark Office*

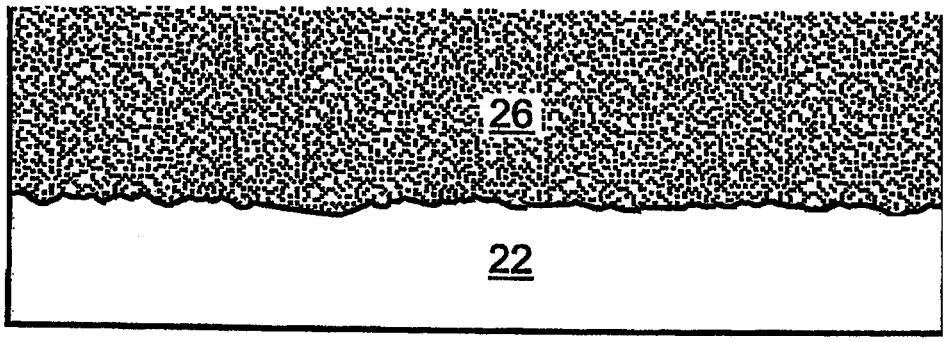
Fig. 3a
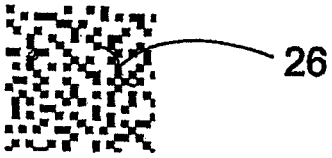
Fig. 3b
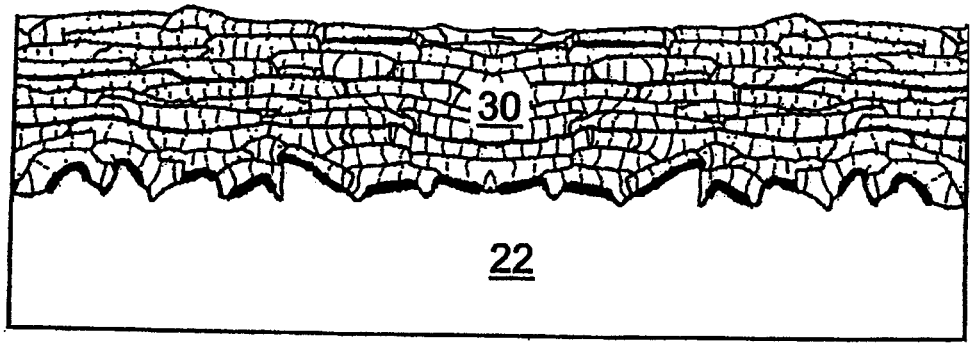
Fig. 4a – PRIOR ART
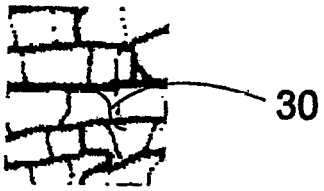
Fig. 4b – PRIOR ART